US009905231B2

(12) United States Patent
Oh et al.

(10) Patent No.: US 9,905,231 B2
(45) Date of Patent: Feb. 27, 2018

(54) AUDIO SIGNAL PROCESSING METHOD

(71) Applicant: INTELLECTUAL DISCOVERY CO., LTD., Seoul (KR)

(72) Inventors: Hyun Oh Oh, Seongnam-si (KR); Taegyu Lee, Seoul (KR); Myungsuk Song, Seoul (KR); Jeongook Song, Seoul (KR)

(73) Assignee: INTELLECTUAL DISCOVERY CO., LTD., Seoul (KR)

( * ) Notice: Subject to any disclaimer, the term of this patent is extended or adjusted under 35 U.S.C. 154(b) by 0 days.

(21) Appl. No.: 14/787,137

(22) PCT Filed: Apr. 15, 2014

(86) PCT No.: PCT/KR2014/003248

§ 371 (c)(1),
(2) Date: Oct. 26, 2015

(87) PCT Pub. No.: WO2014/175591

PCT Pub. Date: Oct. 30, 2014

(65) Prior Publication Data

US 2016/0111096 A1 Apr. 21, 2016

(30) Foreign Application Priority Data

Apr. 27, 2013 (KR) ..... 10-2013-0047054
Apr. 27, 2013 (KR) ..... 10-2013-0047055

(51) Int. Cl.
*H04R 5/00* (2006.01)
*G10L 19/008* (2013.01)
(Continued)

(52) U.S. Cl.
CPC ..... *G10L 19/008* (2013.01); *H04S 3/008* (2013.01); *H04S 7/308* (2013.01); *H04S 2400/03* (2013.01); *H04S 2400/11* (2013.01)

(58) Field of Classification Search
CPC ..... G10L 19/008; H04S 2420/01; H04S 7/30; H04S 2420/07; H04S 3/008; H04S 3/002;
(Continued)

(56) References Cited

U.S. PATENT DOCUMENTS

2014/0226823 A1* 8/2014 Sen ..... G10L 19/167 381/17
2014/0321679 A1* 10/2014 Corteel ..... H04S 7/30 381/300

FOREIGN PATENT DOCUMENTS

KR 10-2004-0037437 A 5/2004
KR 10-2007-0053305 A 5/2007
(Continued)

OTHER PUBLICATIONS

International Search Report for PCT/KR2014/003248 dated Jul. 28, 2014 [PCT/ISA/210].

*Primary Examiner* — Alexander Jamal

(57) ABSTRACT

The present invention relates to an audio signal processing method, comprising the steps of: receiving a bit-stream containing a normal channel signal and an exceptional channel signal; decoding the normal channel signal and the exceptional channel signal from the received bit-stream; generating correlation information using the decoded normal channel signal and the decoded exceptional channel signal; generating a gain value by at least one of a first downmix method applying the same downmix gain value using the correlation information and a second downmix method applying variable gain values over time; and outputting the exceptional channel signal as a plurality of channel signals using the gain value.

6 Claims, 8 Drawing Sheets

(51) Int. Cl.
*H04S 3/00* (2006.01)
*H04S 7/00* (2006.01)

(58) Field of Classification Search
CPC ... H04S 2400/01; H04S 2400/03; H04S 7/302
USPC ... 381/17, 18, 19, 20, 21, 22, 306, 307, 310
See application file for complete search history.

(56) References Cited

FOREIGN PATENT DOCUMENTS

| | | | |
|---|---|---|---|
| KR | 10-2009-0053958 | A | 5/2009 |
| KR | 10-2009-0057131 | A | 6/2009 |
| KR | 10-2010-0086002 | A | 7/2010 |

* cited by examiner

AUDIO SIGNAL PROCESSING METHOD

CROSS REFERENCE TO RELATED APPLICATIONS

This application is a National Stage of International Application No. PCT/KR2014/003248, filed on Apr. 15, 2014, which claims priority from Korean Patent Application No. 10-2013-0047054 and 10-2013-0047055, both filed on Apr. 27, 2013, the contents of all of which are incorporated herein by reference in their entirety.

TECHNICAL FIELD

The present invention generally relates to an audio signal processing method, and more particularly to a method for encoding and decoding an object audio signal and for rendering the signal in 3-dimensional space.

This application claims the benefit of Korean Patent Applications No. 10-2013-0047054 and No. 10-2013-0047055, filed Apr. 27, 2013, which are hereby incorporated by reference in their entirety into this application.

Background Art 3D audio is realized by providing a sound scene (2D) on a horizontal plane, which existing surround audio has provided, with another dimension in the direction of height. 3D audio literally refers to various techniques for providing fuller and richer sound in 3-dimensional space, such as signal processing, transmission, encoding, reproduction techniques, and the like. Specifically, in order to provide 3D audio, a large number of speakers than that of conventional technology are used, or alternatively, rendering technology is widely required which forms sound images at virtual locations where speakers are not present, even if a small number of speakers are used.

3D audio is expected to be an audio solution for a UHD TV to be launched soon, and is expected to be variously used for sound in vehicles, which are developing into spaces for providing high-quality infotainment, as well as sound for theaters, personal 3D TVs, tablet PCs, smart phones, cloud games, and the like.

DISCLOSURE

Technical Problem

In 3D audio, it is necessary to transmit signals having up to 22.2 channels, which is higher than the number of channels in the conventional art, and to this end, an appropriate compression and transmission technique is required.

Conventional high-quality encoding, such as MP3, AAC, DTS, AC3, etc., is optimized to transmit a signal having 5.1 or fewer channels.

Also, to reproduce a 22.2-channel signal, an infrastructure for a listening room in which a 24-speaker system is installed is required. However, this infrastructure may not spread on the market in a short time. Therefore, required are a technique for effectively reproducing 22.2-channel signals in a space in which the number of speakers that are installed is lower than the number of channels; a technique for reproducing an existing stereo or 5.1-channel sound source in a 10.1-, 22.2-channel environment in which the number of speakers that are installed is higher than the number of channels; a technique that enables realizing a sound scene offered by an original sound source in a space in which a designated speaker arrangement and a designated listening environment are not provided; a technique that enables enjoying 3D sound in a headphone listening environment; and the like.

These techniques are commonly called rendering, and specifically, they are respectively called downmixing, upmixing, flexible rendering, and binaural rendering.

Meanwhile, as an alternative for effectively transmitting a sound scene, an object-based signal transmission method is required. Depending on the sound source, transmission based on objects may be more advantageous than transmission based on channels, and in the case of the transmission based on objects, interactive listening to sound source is possible, for example, a user may freely control the reproduced size and position of an object. Accordingly, an effective transmission method that enables an object signal to be compressed so as to be transmitted at a high transmission rate is required.

Also, there may be a sound source in which a channel-based signal and an object-based signal are mixed, and through such a sound source, a new listening experience may be provided. Therefore, a technique for effectively transmitting both the channel-based signal and the object-based signal at the same time is necessary, and a technique for effectively rendering the signals is also required.

Finally, there may be exceptional channels, the signals of which are difficult to reproduce using existing methods due to the distinct characteristics of the channels and the speaker environment in the reproduction environment. In this case, a technique for effectively reproducing the signals of the exceptional channels based on the speaker environment in the reproduction stage is required. Also, in the case of an object signal near the exceptional channels, it is difficult to properly generate sound staging of original content using an existing rendering method. Therefore, a technique for effectively localizing an object signal near the exceptional channels based on a speaker environment at a reproduction stage is required.

Technical Solution

An audio signal processing method according to an embodiment of the present invention includes: receiving a bit-stream including an object signal, which is an exceptional channel signal, and a normal channel signal; distributing a uniform gain value to the normal channel signal; and outputting the exceptional channel signal as multiple channel signals using the gain value.

An exceptional channel to which the exceptional channel signal will be output may be a channel that is located above a top of a user's head.

A normal channel to which the normal channel signal will be output may be located in an identical plane in which the exceptional channel is located.

An audio signal processing method according to an embodiment of the present invention includes: receiving a bit-stream including both an object signal and object position information; receiving past object position information from a storage medium; generating an object moving path using the object position information and the received past object position information; selecting a speaker that is located at a position of which a distance from the object moving path is equal to or less than a certain distance; downmixing the object position information to be adapted to the selected speaker; and outputting, by the selected speaker, the object signal.

Downmixing the object position information to be adapted to the selected speaker may be based on Vector Base Amplitude Panning (VBAP).

A speaker to which the object signal will be output may be a speaker located in a plane above a top of a user's head.

An audio signal processing method according to an embodiment of the present invention includes: receiving a bit-stream including both a normal channel signal and an exceptional channel signal; decoding the exceptional channel signal and the normal channel signal from the received bit-stream; generating correlation information using the decoded exceptional channel signal and the decoded normal channel signal; generating correlation information using the decoded normal channel signal; generating a gain value through at least one of a first downmix method, which applies a uniform downmix gain value using the correlation information, and a second downmix method, which applies a variable gain value according to time; and outputting the exceptional channel signal as multiple channel signals using the gain value.

The first downmix method may apply the uniform downmix gain value to multiple channels.

The first downmix method may compensate for the gain value and delay information using speaker position information.

The first downmix method may distribute the uniform gain value to equally divided spaces.

The second downmix method may variably adjust the downmix gain value according to time by estimating a moving path of a sound image based on the correlation information.

An audio signal processing method according to an embodiment of the present invention includes: receiving a bit-stream including an object signal and object position information; decoding the object signal and the object position information from the received bit-stream; receiving past object position information from a storage medium; generating an object moving path using the decoded object position information and the received past object position information; selecting either a first downmix method, which applies a uniform gain value using the object moving path, or a second downmix method, which applies a variable gain value according to time; generating a gain value using the selected downmix method; and generating a channel signal from the decoded object signal using the generated gain value.

The first downmix method may apply the uniform downmix gain value to multiple channels.

The second downmix method may variably adjust a channel gain value according to time using the object signal moving path.

The second downmix method may variably determine a number of speakers according to selection of a system.

Advantageous Effects

According to the present invention, when a channel in an exceptional position or a channel for an exceptional function does not exist, a sound source may be effectively reproduced according to the feature of the sound source. A typical example of such an exceptional channel is TpC, which is located directly above a user's head, and TpC is a channel for a distinct function, which gives an effect as if a voice were heard from above a head, like the voice of God.

In the case of TpC, because it gives a special effect, when this channel does not exist, it must be effectively reproduced using other channels. The present invention has the effect of compensating for the lack of such an exceptional channel. The effects of the present invention are not limited to the above-mentioned effects, and unmentioned effects are clearly understood from this specification and the accompanying drawings by those skilled in the art.

BEST MODE

Figure 1:
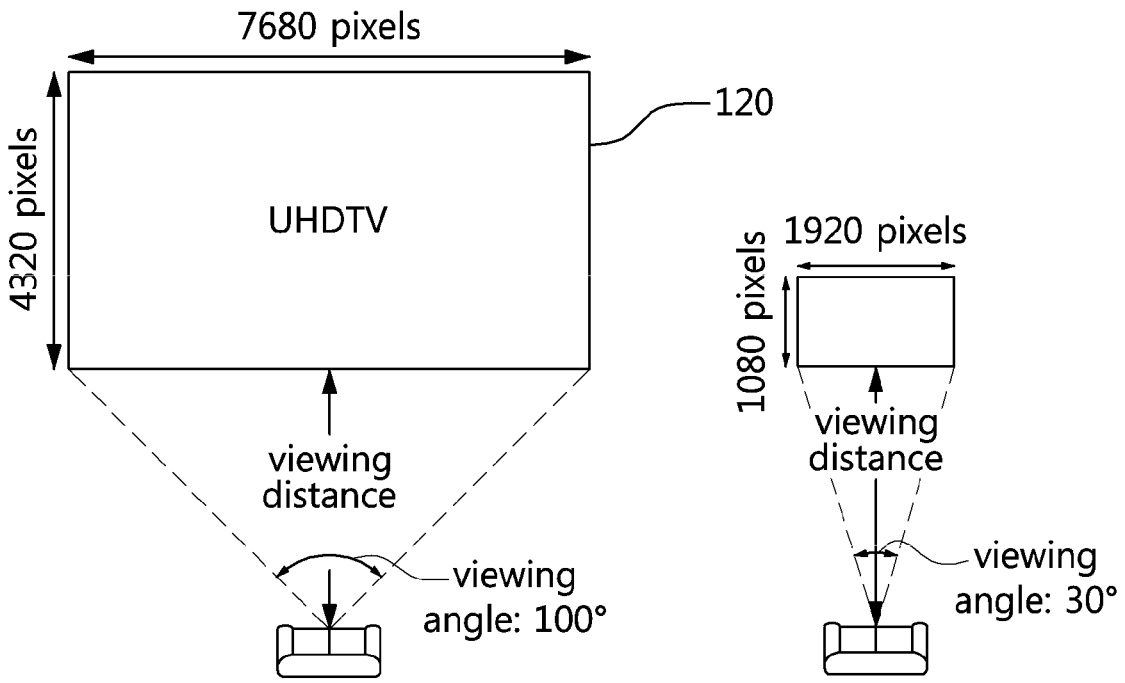
FIG. 1 is a view describing a viewing angle according to a display size at the same viewing distance.

The embodiment described in this specification is provided for allowing those skilled in the art to more clearly comprehend the present invention. The present invention is not limited to the embodiment described in this specification, and the scope of the present invention should be construed as including various equivalents and modifications that can replace the embodiments and the configurations at the time at which the present application is filed. The terms in this specification and the accompanying drawings are for easily describing the present invention, and the shape and size of the elements shown in the drawings may be exaggeratedly drawn. The present invention is not limited to the terms used in this specification or to the accompanying drawings. In the following description, when the functions of conventional elements and the detailed description of elements related with the present invention may make the gist of the present invention unclear, a detailed description of those elements will be omitted. In the present invention, the following terms may be construed based on the following criteria, and terms which are not used herein may also be construed based on the following criteria. The term "coding" may be construed as encoding or decoding, the term "information" includes values, parameters, coefficients, elements, etc. and the meanings thereof may be differently construed according to the circumstances, and the present invention is not limited thereto.

Hereinafter, an audio signal processing method and device according to the present invention are described.

FIG. 1 is a view for describing a viewing angle according to a display size (for example, UHD TV and HD TV) at the same viewing distance.

Display sizes are increasing according to the development of display manufacturing technology and consumers' demands. As shown in FIG. 1, a UHD TV (7680*4320 pixels display) has a display that is 16 times larger than an HD TV 120 (1920*1080 pixels display). When an HD TV is installed on the wall of a living room and a viewer sits on a couch at a constant distance from the TV, the viewing angle may be about 30°.

However, when a UHD TV is installed at the same distance, the viewing angle amounts to about 100°. When such a high-resolution high-definition large screen is installed, it is desirable to provide vivid and fuller sound as befits the large-scale content. 12 surround channel speakers may not be sufficient to provide an environment that enables viewers to feel as if they are in the scene. Therefore, a multi-channel audio environment having more speakers and more channels may be required.

Besides the above-mentioned home-theater environment, a personal 3D TV, a smart phone TV, a 22-channel audio program, a vehicle, a 3D video, a telepresence room, a cloud-based game, and the like may require a multi-channel audio environment that has more speakers and more channels than 12 surround channel speakers.

Also, the present invention that will be described below may be applied to a personal 3D TV, a smart phone TV, a 22-channel audio program, a vehicle, a 3D video, a telepresence room, a cloud-based game, and the like, in addition to a home theater environment.

Figure 2:
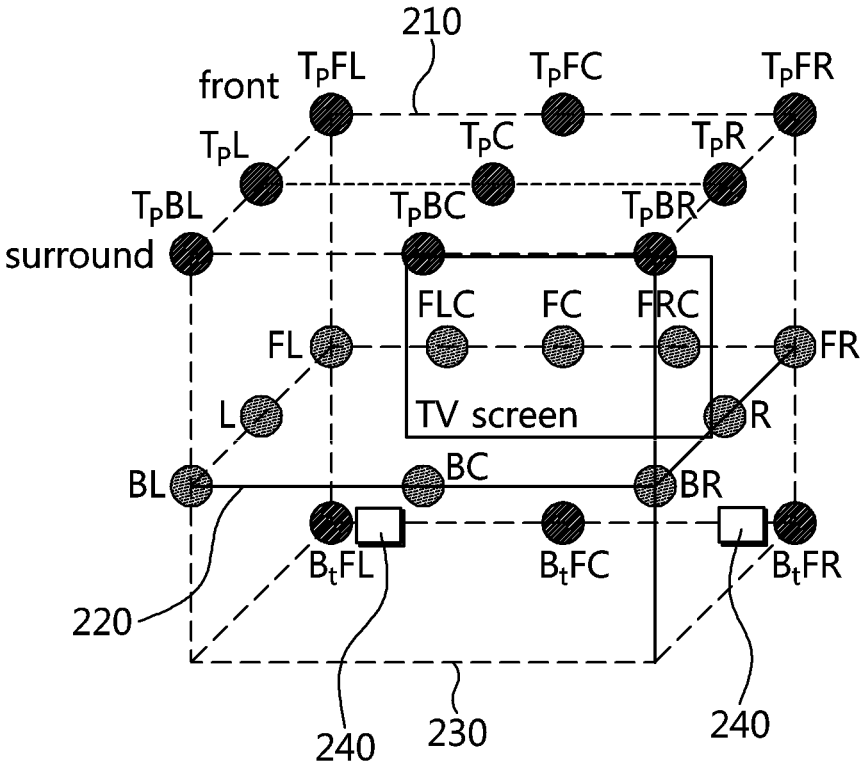
FIG. 2 is a configuration diagram in which 22.2-channel speakers are arranged as an example of a multi-channel arrangement.

FIG. 2 is a view illustrating 22.2-channel speaker placement as an example of a multi-channel arrangement.

22.2 channels may be an example of a multi-channel environment for improving sound staging, and the present invention is not limited to a specific number of channels or to a specific speaker arrangement.

Referring to FIG. 2, the 22.2 channels are arranged by being distributed among three layers 210, 220, and 230. The three layers 210, 220, and 230 include a top layer 210 in the highest position among the three layers, a bottom layer 230 in the lowest position, and a middle layer 220 between the top layer 210 and the bottom layer 230.

According to an embodiment of the present invention, a total of 9 channels, namely TpFL, TpFC, TpFR, TpL, TpC, TpR, TpBL, TpBC, and TpBR, may be provided in the top layer 210. Referring to FIG. 2, it is confirmed that speakers are disposed in the 9 channels of the top layer 210 in such a way that there are 3 channels TpFL, TpFC, and TpFR arranged from left to right at the front, 3 channels TpL, TpC, and TpR arranged from left to right at the center position, and 3 channels TpBL, TpBC, and TpBR arranged from left to right at the back position. In this specification, the front side may mean the screen side.

According to an embodiment of the present invention, a total of 10 channels, namely FL, FLC, FC, FRC, FR, L, R, BL, BC, and BR, may be provided in the middle layer 220. Referring to FIG. 2, speakers may be disposed at the 5 channels, that is, FL, FLC, FC, FRC, and FR, arranged from left to right at the front, in the 2 channels, L and R, arranged at left and right at the center position, and in the 3 channels, BL, BC, and BR, arranged from left to right at the back position. Among the 5 speakers at the front, the 3 speakers at the center position may be included in a TV screen.

According to an embodiment of the present invention, in the bottom layer 230, a total of 3 channels, BtFL, BtFC, and BtFR, may be provided at the front, and 2 LFE channels 240 may also be provided. Referring to FIG. 2, speakers may be disposed at each of the channels in the bottom layer 230.

To transmit and reproduce multi-channel signals that range up to dozens of channels more than 22.2, a high computational load may be necessary. Also, a high compression rate may be required in consideration of the communication environment.

Furthermore, many households have 2-channel or 5.1-channel speaker setups, rather than a multi-channel speaker environment (for example, a 22.2-channel environment). Therefore, if signals that are commonly transmitted to all users are signals obtained by encoding multi-channel signals, the multi-channel signals may be reproduced after being converted to 2-channel or 5.1-channel signals, and as a result, inefficiency may be caused in communications. Also, because 22.2-channel PCM signals must be stored, it may be inefficient in terms of memory management.

(Need for Flexible Rendering)

Among techniques for 3D audio, flexible rendering is an important task to be solved in order to improve the quality of 3D audio to the highest level. It is well known that 5.1-channel speakers are often atypically placed according to the structure of a living room and the furniture layout. The speakers should be able to provide the sound scene that is intended by a content producer even when speakers are atypically placed. To this end, the differences in the speaker environment based on a user's reproduction environment must be understood, and a rendering technique for calibrating the difference between the user speaker environment and the speaker arrangement according to a standard specification is required. In other words, a codec should provide not only for the decoding of transmitted bit-streams by a decoding method but also a series of techniques for converting the bit-streams to be optimized for the user's reproduction environment.

(Flexible Rendering)

A process for determining the direction of a sound source between two speakers based on the amplitude of a signal may be amplitude panning. Also, using VBAP, which is widely used for determining the direction of a sound source by using three speakers in a 3-dimensional space, rendering may be conveniently implemented for the object signal, which is transmitted on an object basis. This is an advantage of the transmission of an object signal based on VBAP, compared to transmission of a channel.

(Voice of God)

In a multi-channel audio system, TpC (Top of center), which is the channel located above a listener's head, is called the 'Voice of God'. The reason why this channel is called the 'Voice of God' is that the use of this channel may generate a very dramatic effect, as if a voice were heard from the sky. Besides, various effects may be obtained by using this channel, for example, there may be a situation in which something drops from right overhead, firecrackers are set off overhead, someone shouts from the roof of a tall building, etc. TpC according to an embodiment of the present invention may be a channel disposed above the top of a listener's head.

Also, TpC is an important channel in various scenes, such as a scene in which an airplane comes from the front, passes above the viewer's head, and moves to the rear. In other words, TpC may provide a vivid sound field, which cannot be supported by existing audio systems, to a user in many dramatic scenes.

As described above, TpC provides various effects. However, because it is difficult to install a speaker in the position corresponding to TpC and to generate sound in TpC, it may become an exceptional channel.

When TpC is an exceptional channel, i.e. when there is no speaker at the corresponding position, the use of an existing flexible rendering method is not effective to compensate for such a situation, and it is difficult to expect a satisfactory result. Therefore, a method for effectively outputting the exceptional channel through another output channel is necessary.

To reproduce multi-channel content through a number of output channels that is less than the number of channels in the content, a method based on an MN downmix matrix (where M is the number of input channels and N is the number of output channels) is generally implemented. In other words, when reproducing 5.1-channel content in stereo, the 5.1 channel content is downmixed using a given formula. In this case, the method for implementing downmixing uses a method whereby relative downmix gain is applied to speakers in spatial proximity and the results are synthesized.

For example, when there is no speaker at a position corresponding to TpFC of a top layer 210, TpFC may be downmixed to FC (or FRC, FLC) in a middle layer and synthesized. Namely, sound corresponding to the position of TpFC, which is an exceptional channel, may be reproduced by generating a virtual TpFC using speakers disposed at FC, FRC, and FLC.

However, when TpC is an exceptional channel, because the positions of front, back, left, and right of TpC are uncertain based on the position of a listener, it is difficult to determine the position of speakers that are spatially close to TpC, among the speakers arranged at the channels of a middle layer 220. Also, when downmix rendering is performed on signals that are assigned to TpC in an atypical speaker arrangement environment, it may be effective to flexibly change the downmix matrix in connection with a flexible rendering technique.

To solve such a problem, if a sound source reproduced through TpC is an object corresponding to the "Voice of God" and it is an object that can only be reproduced at TpC or an object reproduced based on TpC, it is desirable to downmix the object according to the situation.

However, when the sound source to be reproduced is a part of an object reproduced in the overall top layer 210, or when the sound source to be reproduced comes from the position of TpFL, passes through TpC, and goes to TpBR, for example, to express the moment in which an airplane passes by in the sky, it is desirable to use a downmixing method specialized for such a situation. Furthermore, when only a limited number of speakers may be used because the position of the speakers is different from the above-mentioned situations, it is necessary to consider a rendering method for locating a sound source at various angles. There is an elevation spectral cue, which is a cue to enable a person to recognize sound source elevation. For example, because of the shape of human's pinnae, the cue may be a notch and a peak in a certain high frequency band. Therefore, by intentionally inserting the cue for recognizing sound source elevation, it is possible to realize the effect of generating sound at TpC.

When an object signal according to an embodiment of the present invention is VoG, the object signal may be a TpC signal.

An object signal according to an embodiment of the present invention may indicate a VoG signal or a TpC signal.

Hereinafter, an audio signal processing device and a signal processing method according to an embodiment of the present invention are described with reference to the drawings.

Figure 3:
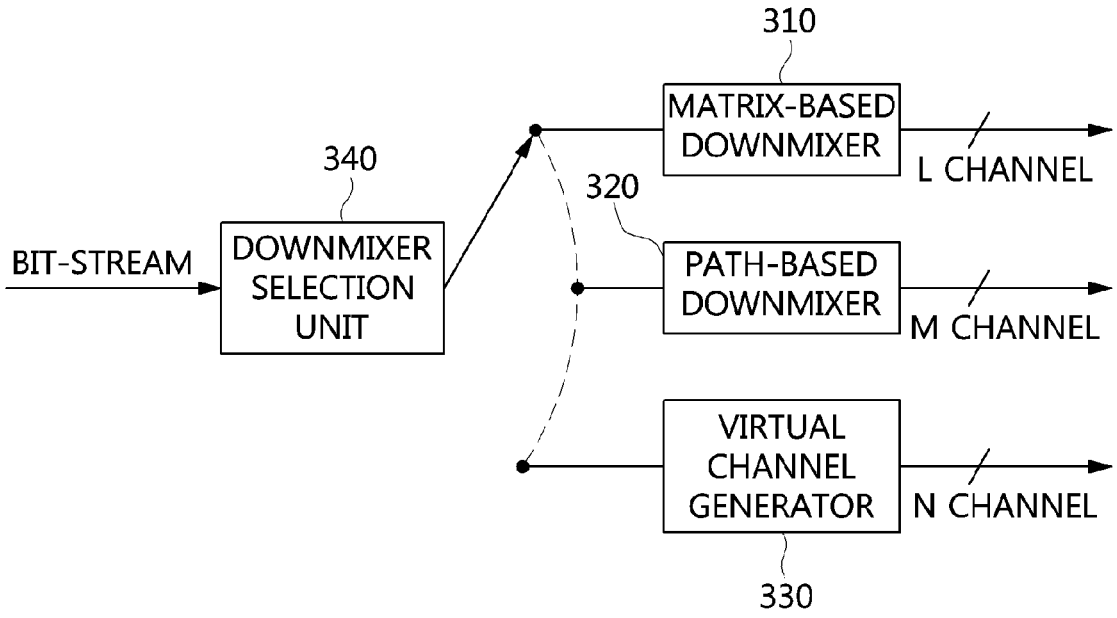
FIG. 3 is a concept diagram for describing a process in which an exceptional signal is downmixed.

FIG. 3 is a block diagram of an audio signal processing device according to an embodiment of the present invention.

Referring to FIG. 3, an audio signal processing device according to an embodiment of the present invention includes a matrix-based downmixer 310, a path-based downmixer 320, a virtual channel generator 330, and a downmixer selection unit 340. However, because the components illustrated in FIG. 3 are not essential components, an audio signal processing device having more or fewer components than the number of components of FIG. 3 may be implemented.

A downmixer selection unit 340 receives a bit-stream as an input, and selects a signal processing method for an exceptional channel signal. The downmixer selection unit 340 according to an embodiment of the present invention may receive an object signal and object position information. The bit-stream may include the object signal and the object position information. When the object signal of the bit-stream corresponds to an exceptional channel signal, the downmixer selection unit 340 selects the signal processing method for the exceptional channel signal. The object signal according to an embodiment of the present invention may be a sound source.

Also, an object signal according to an embodiment of the present invention may include a VoG signal output from above the top of a receiver's head or a TpC signal output from TpC.

The downmixer selection unit 340 may select a downmixing method by analyzing the specific value of an exceptional channel signal or the characteristics of the signal. As an embodiment of an exceptional channel signal, there is a TpC signal, which is output from TpC, which is located above a listener's head. An exceptional channel signal according to an embodiment of the present invention may be a signal output from an exceptional channel. Also, an exceptional channel signal according to an embodiment of the present invention may be a sound source heard from an exceptional channel.

When an exceptional channel signal is stationary at the position above the head or the exceptional channel signal is an ambient signal having ambiguous directionality, it is appropriate to apply the same downmix gain to multiple channels. When an exceptional channel signal is stationary at the position above a head or the exceptional channel signal is an ambient signal having ambiguous directionality, the downmixer selection unit 340 according to an embodiment of the present invention downmixes the exceptional channel signal using a matrix-based downmixer 310.

When an exceptional channel signal in a sound scene that is in motion is downmixed using a matrix-based downmixer 310, the sound scene, which was intended to be dynamic by the content provider, becomes static. To prevent this problem, the downmixer selection unit 340 according to an embodiment of the present invention analyzes the channel signals and may downmix the exceptional channel signals, which are included in the sound scene that is in motion, so as to have a variable gain value. In this specification, the device that downmixes an exceptional channel signal that is included in an in-motion sound scene so that it has a variable gain value is called a path-based downmixer 320.

When a desired effect in reproducing an exceptional channel signal cannot be achieved only using nearby speakers, a spectral cue, which enables a person to recognize sound source elevation, may be used in the output signals of specific N speakers. A device operated based on such a method is called a virtual channel generator 330.

The downmixer selection unit 340 selects which downmix method is to be used by using input bit-stream information or by analyzing input channel signals. According to the selected downmix method, L, M, or N output signals are selected as channel signals.

(Downmixer Selection Unit)

Figure 4:
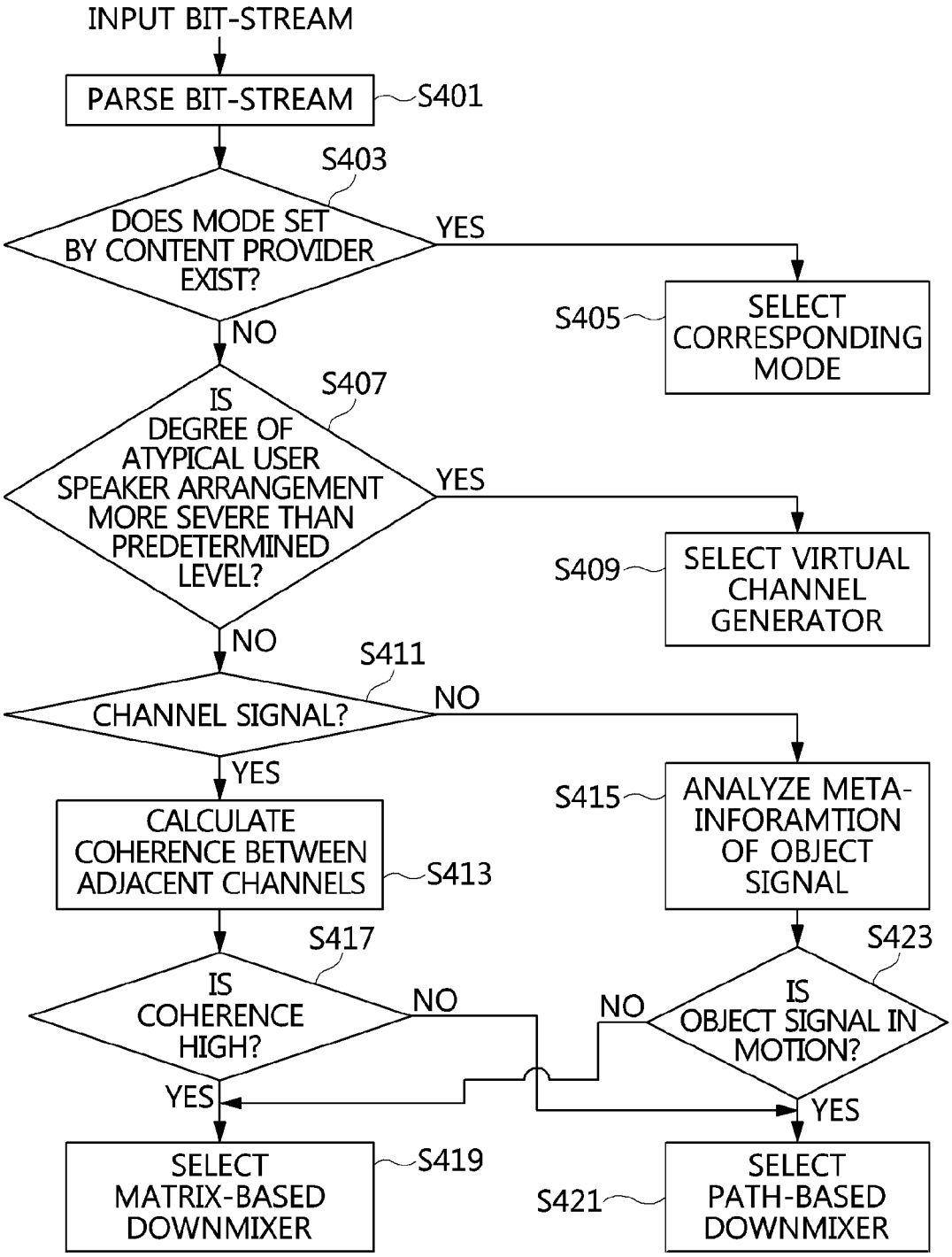
FIG. 4 is a flowchart of a downmixer selection unit.

FIG. 4 is a flowchart showing the method of operation of an audio signal processing device according to an embodiment of the present invention.

First, the downmixer selection unit 340 parses an input bit-stream at step S401. In this case, the downmixer selection unit 340 may receive a bit-stream that includes an object signal and object position information. Also, the downmixer selection unit 340 may decode the input object signal and the input object position information.

The downmixer selection unit 340 checks whether the mode that the content provider has set exists based on the parsed bit-stream at step S403.

When the mode that was set by the content provider exists, downmixing is performed using a parameter of the corresponding mode at step S405.

When the mode that was set by the content provider does not exist, the downmix selection unit 340 determines whether the user's speaker arrangement is atypical at step S407. In this case, the downmixer selection unit 340 may determine whether the degree of the atypical user speaker arrangement is more severe than a predetermined level.

When the speaker arrangement is atypical, the downmixer selection unit 340 selects a virtual channel generator 330. When the virtual channel generator 330 is selected, the virtual channel generator 330 performs downmixing. Under the condition that the speaker arrangement is atypical, when downmixing is performed only by adjusting the gain value for channels that are close to an exceptional channel, as described above, because the sound scene intended by the content provider cannot be sufficiently reproduced, various cues that enable a person to recognize a high elevation sound image should be used to solve such a problem.

When the speaker arrangement is not atypical, the downmixer selection unit 340 determines whether an object signal is a channel signal at step S411.

When the object signal is a channel signal, the downmixer selection unit 340 calculates coherence between the object position based on the object position information and adjacent channels at step S413.

If the object signal is not a channel signal, the downmixer selection unit 340 analyzes meta-information of the object signal at step S415.

After the step S413, the downmixer selection unit 340 determines whether the calculated coherence is high at step S417. When determining whether the coherence is high, the downmixer selection unit 340 may determine the degree based on a predetermined value.

When the coherence is high, the downmixer selection unit 340 selects a matrix-based downmixer 310 at step S419. In this case, the matrix-based downmixer 310 downmixes the object signal.

When the coherence is not high, the downmixer selection unit 340 selects a path-based downmixer 320 at step S421. In this case, the path-based downmixer 320 downmixes the object signal.

After the step S415, the downmixer selection unit 340 determines whether the object signal is in motion at step S423. The downmixer selection unit 340 according to an embodiment of the present invention may determine whether the object is in motion based on meta-information of the object signal When the object signal is in motion, the downmixer selection unit 340 selects a path-based downmixer 320 at step S421. In this case, the path-based downmixer 320 downmixes the object signal.

When the object signal is not in motion, the downmixer selection unit 340 selects a matrix-based downmixer 310 at step S419. In this case, the matrix-based downmixer 310 downmixes the object signal.

Next, the process in which the downmixer selection unit 340 selects a downmixing method based on whether or not the speaker arrangement is atypical is described. Here, the determination of whether the speaker arrangement is atypical has been mentioned in the above description of step S407.

Referring to FIG. 2, the downmixer selection unit 340 may analyze the sum of the distances between the position vector of speakers in a top layer and the position vector of the speakers in the top layer at a reproduction stage.

Suppose that the position vector of the i-th speaker in the top layer is Vi, and the position vector of the i-th speaker at the reproduction stage is Vi'. Also, if a weighted value according to the importance of a speaker position is wi, a speaker position error Espk may be defined as the following Equation 1.

$$Espk = \sum_i \|Vi - Vi'\| \quad \text{[Equation 1]}$$

When the user's speaker arrangement is very atypical, the speaker position error Espk has a higher value. Therefore, when the speaker position error Espk is equal to or greater than (or is greater than) a certain threshold, the downmixer selection unit 340 selects a virtual channel generator 330.

Next, steps S409 to S421 are described in detail.

When the speaker position error is equal to or less than (or is less than) the certain threshold, the downmixer selection unit 340 selects a matrix-based downmixer 310 or a path-based downmixer 320.

When a sound source to be downmixed or an object signal to be downmixed is a channel signal, a downmix method may be selected according to the estimated width of the sound image of the channel signal. This is because a sophisticated sound image localization method is unnecessary when the apparent source width of the sound image is wide because human being's localization blur, which will be described later, is very large in a horizontal plane compared to a median plane. As an embodiment that measures the apparent source widths of sound images in multiple channels, there is a measurement method using interaural cross correlation.

However, this method requires a very complicated operation. Therefore, when supposing that the cross correlation between a TpC signal and each channel is proportional to the interaural cross correlation, the apparent source widths of sound images may be estimated using a low computational load by using the sum of the cross correlations between the TpC signal and each channel.

If the total C of the cross correlations between the TpC channel signal and nearby channel signals is equal to or greater than (or is greater than) a certain threshold value, the apparent source width of the sound image is wider than a criterion, and as a result, a matrix-based downmixer 310 is selected. If not, because the apparent source width of the sound image is narrower than the criterion, a more sophisticated path-based downmixer 320 is selected.

When a user's speaker arrangement is very atypical, the speaker position error Espk has a very high value. Therefore, when the speaker position error is equal to or greater than (or is greater than) a certain threshold value, the downmixer selection unit 340 selects a virtual channel generator 330.

When the speaker position error is equal to or less than the certain threshold value, the downmixer selection unit 340 selects a matrix-based downmixer or a path-based downmixer.

The two downmixers may select a downmix method according to the change in the position of an object signal.

The position information of the object signal is included in meta-information that is obtained by parsing an input bitstream. Meta-information according to an embodiment of the present invention is represented by azimuth, elevation, and the distance between the center of the speaker arrangement and the object or radius. As an embodiment for measuring the variation in the position of the object signal, variance or standard deviation, i.e. the statistical characteristics of the position of the object signal during N frames, may be used. When the measured variation in the object signal position is equal to or greater than (or is greater than) a certain threshold value, because the position of the corresponding object is greatly changed, the downmixer selection unit 340 selects a more sophisticated path-based downmix method 320. Conversely, when the measured variation is less than the threshold value, because the corresponding object signal is considered to be a static sound source, the downmixer selection unit 340 selects a matrix-based downmixer 310, which capable of effective downmixing signals using a low computational load owing to the above-described human being's localization blur.

(Static Sound Source Downmixer/Matrix-Based Downmixer)

Figure 5:
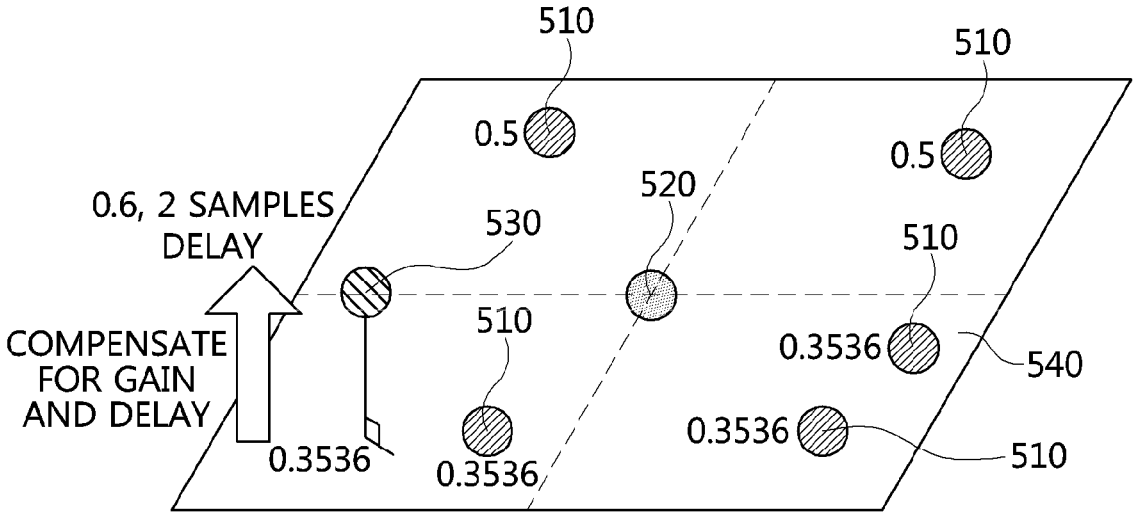
FIG. 5 is a concept diagram for describing a simplified method in a matrix-based downmixer.
Figure 6:
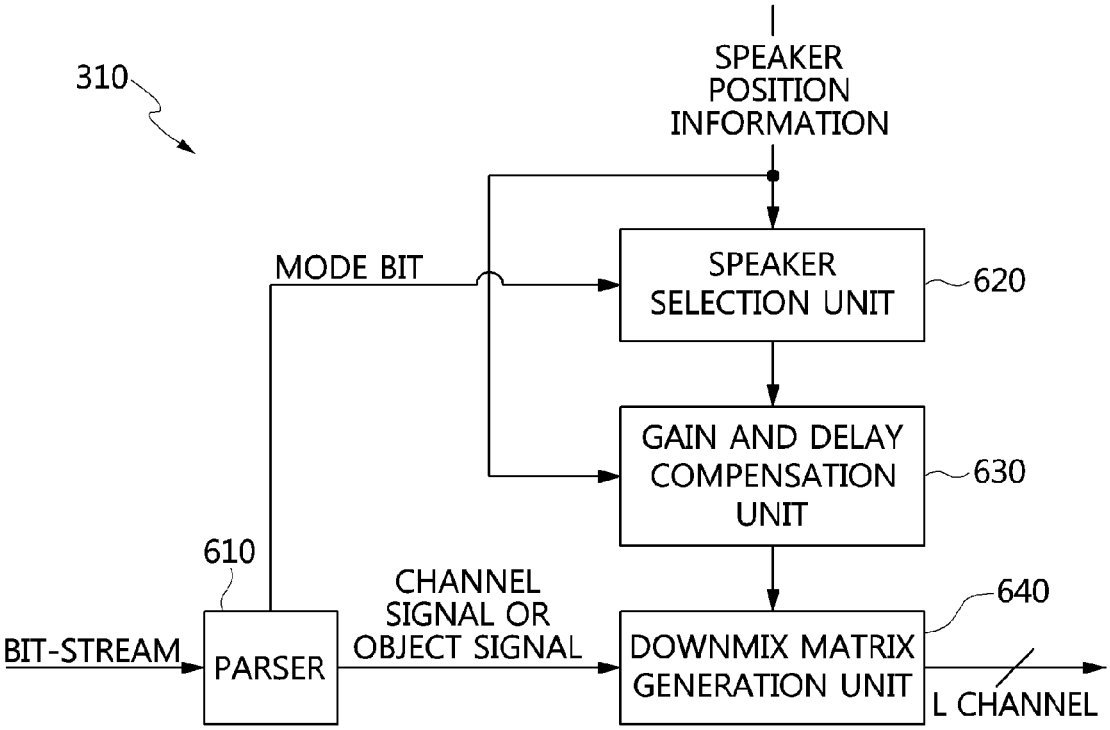
FIG. 6 is a concept diagram of a matrix-based downmixer.

Next, referring to FIGS. 5 and 6, a matrix-based downmixer according to an embodiment of the present invention is described.

FIG. 5 is a concept diagram for describing the method of operation of the matrix-based downmixer.

FIG. 6 is a concept diagram of the matrix-based downmixer.

Various psychoacoustic experiments show that the localization of a sound image in a median plane is very different from that in a horizontal plane. Localization blur has the purpose of representing the measured inaccuracy in the localization of the sound image as a numerical value, and it represents the range in which the position of the sound image is not distinguishable in a specific position as an angle. According to the above-mentioned experiments, a voice signal has an inaccuracy falling within the range from 9° to 17°. However, considering that a voice signal in a horizontal plane has an inaccuracy from 0.9° to 1.5°, it is confirmed that the localization of a sound image in a median plane has very low accuracy. Because, in the case of a sound image having a high elevation, location accuracy as perceived by a person is low, downmixing using a matrix is more effective than a sophisticated localization method.

According to an embodiment of the present invention, when there is no speaker at a TpC channel, among the channels of a top layer 210, sound may be output at TpC using the speakers arranged in the top layer 210 by distributing the same gain value to the other channels.

In the case of a sound image the position of which is not largely changed, the absent TpC may be upmixed to multiple channels by distributing the same gain value to the channels in the top layer 210, in which speakers are symmetrically arranged.

When the channels in the top layer 210 in the channel environment at the reproduction stage are the same as those of the configuration in FIG. 2 excluding TpC, the channel gain values distributed to the top layer 210 have the same value. However, as is known, it is uncommon to have a typical channel environment at the reproduction stage, as illustrated in FIG. 2. When the same gain value is distributed to all the channels described above in an atypical channel environment, the angle between the sound image and the position intended by the content may be larger than the value of localization blur. This makes a user perceive the sound image incorrectly. To prevent such a problem, a process for compensating for the atypical channel environment is necessary.

Because a channel that is located at the top layer 210 arrives at the position of a listener in the form of a plane wave, the existing downmix method, in which a uniform gain value is set, realizes the plane wave, which is generated in TpC, using nearby channels. In the plane including the top layer 210, the center of gravity of a polygon of which the vertexes correspond to the positions of speakers is consistent with the position of TpC. Therefore, the gain value for each of the channels in the atypical channel environment may be obtained using an equation in which the center of gravity of the 2-dimensional position vectors in the plane including the top layer 210 is consistent with the vector of the TpC position, wherein the top layer includes channels to which the gain value is weighted.

However, an approach using this equation requires a high computational load, and there is little difference in performance compared to the simplified method that will be described below.

The simplified method is described referring to FIG. 5.

First, a matrix-based downmixer 310 divides an area into N equiangular areas. The matrix-based down mixer 310 assigns the same gain value to the equiangular areas. If two or more speakers are located within the area, the matrix-based downmixer 310 sets the sum of the square of gain that will be assigned to the speakers the same as the above-mentioned gain value.

As an embodiment of the above-mentioned approach, suppose a speaker arrangement in which there is a speaker 510 located in a plane including the top layer 210, a TpC speaker 520, and a speaker 530 located outside of the plane including the top layer 210 as shown in FIG. 5.

When an area is divided into 4 equiangular areas with 90° based on TpC 520, the matrix-based downmixer 310 assigns a gain value to make the sum of the squares of the gain value become 1. In this case, because there are four areas, the gain value for each area is 0.5. When two or more speakers exist within a single area, the matrix-based downmixer 310 sets a gain value to make the sum of the squares of the gain value be the same as the gain value for the area. Therefore, the gain value for the outputs of two speakers in the lower right area 540 is 0.3536. Finally, in the case of the speaker 530 located outside of the plane including the top layer, the matrix-based downmixer 310 calculates a gain value when the speaker 530 is projected onto the plane including the top layer, and then compensates for the difference in distance between the speaker and the plane using the gain value and delay.

The matrix-based downmixer 310 according to an embodiment of the present invention distributes the same gain value to normal channel signals. The matrix-based downmixer 310 outputs an exceptional channel signal as multiple channel signals using the gain value. The exceptional channel signal may be TpC, which is located above the top of a user's head. Also, a normal channel that outputs a normal channel signal may be arranged at the top layer 210.

Next, referring to FIG. 6, a matrix-based downmixer 310 is described.

The matrix-based downmixer 310 according to an embodiment of the present invention distributes the same gain value to normal channel signals. The matrix-based downmixer 310 outputs an exceptional channel signal as multiple channel signals using the gain value. The exceptional channel signal may be TpC, which is located above the top of a user's head. Also, a normal channel that outputs a normal channel signal may be arranged at the top layer 210.

The matrix-based downmixer 310 according to an embodiment of the present invention includes a parser 610, a speaker determination unit 620, a gain and delay compensation unit 630, and a downmix matrix generation unit 640. However, because the components illustrated in FIG. 6 are not essential, a matrix-based downmixer having more or fewer components than the components of FIG. 6 may be implemented.

The parser 610 separates a mode bit that is provided by a content provider and a channel signal or an object signal from a bit-stream.

When a mode bit is set, the speaker determination unit 620 selects a corresponding speaker group. When the mode bit is not set, the speaker determination unit 620 selects the speaker group at the shortest distance based on the information about the position of the speakers that are currently used by a user.

The gain and delay compensation unit 630 compensates for the gain and delay of each of the speakers in order to compensate for the difference in the distance between the set speaker group and the speaker arrangement of the user.

By applying the gain and delay, which are output from the gain and delay compensation unit 630, the downmix matrix generation unit 640 downmixes the channel signal or the object signal, which is output from the parser, to other channels.

Figure 7:
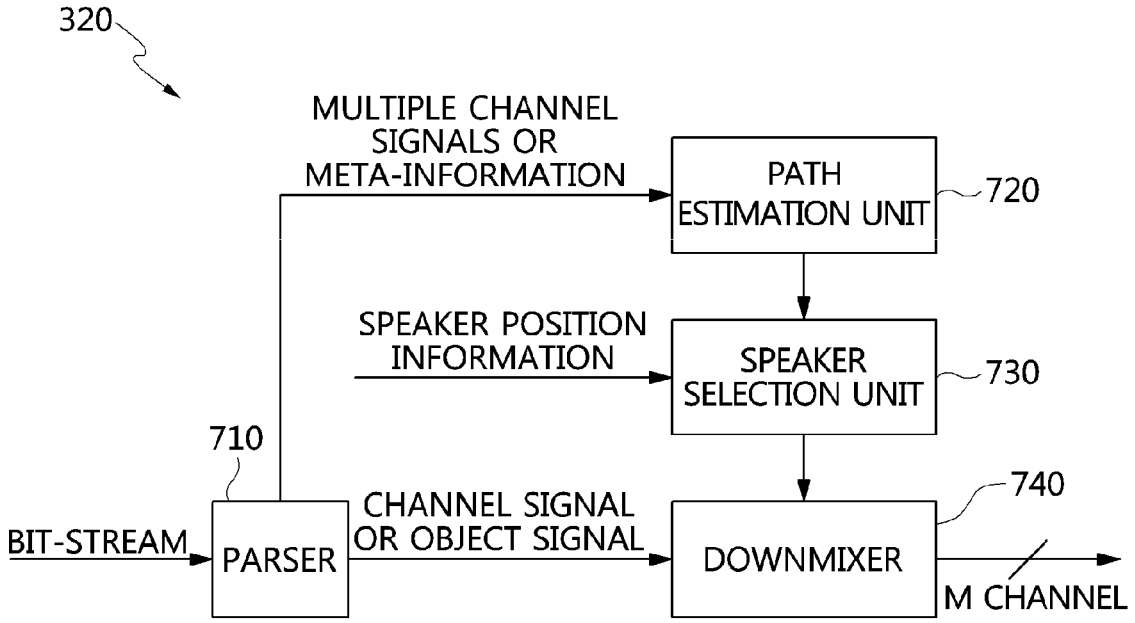
FIG. 7 is a concept diagram of a path-based downmixer.

Next, referring to FIG. 7, a path-based downmixer 320 is described.

FIG. 7 is a concept diagram of the path-based downmixer.

(Dynamic Sound Source Downmixer/Path-Based Downmixer)

The path-based downmixer 320 according to an embodiment of the present invention receives the past object position information. The past object position information may be stored in a storage medium (not illustrated). The path-based downmixer 320 selects a speaker that is located at a position of which the distance from an object path is equal to or less than a certain distance. The path-based downmixer 320 downmixes the object position information to be adapted to the selected speaker. The path-based downmixer makes the selected speaker output the object signal.

The path-based downmixer 320 according to an embodiment of the present invention includes a parser 710, a path estimation unit 720, a speaker selection unit 730, and a downmixer 740. However, because the components illustrated in FIG. 7 are not essential, a path-based downmixer having more or fewer components may be implemented.

The parser 710 parses a bit-stream, and transmits an exceptional channel signal and a plurality of nearby channel signals to the path estimation unit 720. Also, the parser may separate a channel signal or an object signal from the bit-stream. Also, the parser 710 may separate multiple channel signals or meta-information from the bit-stream.

The path estimation unit 720 receives the separated channel signals or meta-information from the parser 710. In the case of multiple channel signals, the path estimation unit 720 estimates the cross correlation between the channels, and the change of the channels, the cross correlation of which is high is estimated to be a path. Also, the path estimation unit 720 may estimate the path of the object based on the past object position information stored in the storage medium (not illustrated).

The speaker selection unit 730 selects speakers located at positions of which the distance from the path, which is estimated by the path estimation unit 720, is equal to or less than a certain distance.

The position information of the selected speakers is transmitted to the downmixer 740. The downmixer 740 downmixes the channel signal or the object signal to be adapted to the selected speakers. Vector base amplitude panning (VBAP) is an example of the above-mentioned downmix method.

Figure 8:
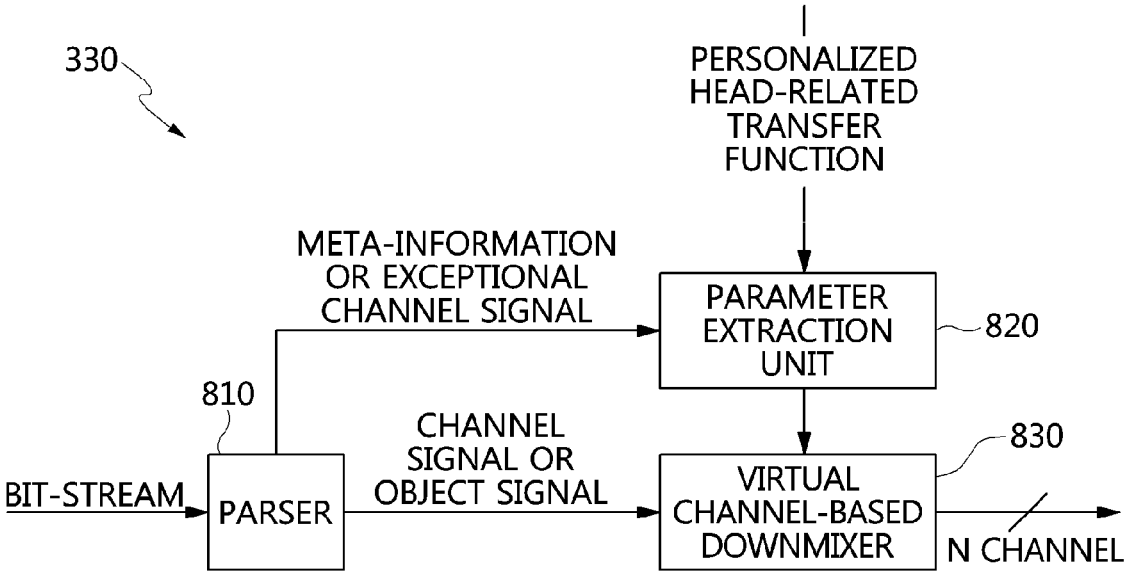
FIG. 8 is a concept diagram of a virtual channel generator.

Next, referring to FIG. 8, a virtual channel generator is described.

(Virtual Channel Generator)

FIG. 8 is a concept diagram of the virtual channel generator.

A virtual channel generator 330 according to an embodiment of the present invention includes a parser 810, a parameter extraction unit 820, and a virtual channel-based downmixer 830. However, because the components illustrated in FIG. 8 are not essential, a virtual channel generator 330 having more or fewer components may be implemented.

The parser 810 parses an input bit-stream to an exceptional channel signal. Also, the parser 810 separates meta-information and a channel signal or an object signal from the bit-stream. Also, the parser 810 transmits the meta-information or the exceptional channel signal to the parameter extraction unit 820.

The parameter extraction unit 820 extracts a parameter using a generalized Head-Related Transfer Function, which is included in the transmitted exceptional channel signal, or using a provided personalized Head-Related Transfer Function.

As an embodiment of the parameter, there is a notch or peak frequency and the magnitude information in specific spectrum, or the binaural level difference and binaural phase difference in a specific frequency.

The virtual channel-based downmixer 830 performs downmixing based on the transmitted parameter. As an embodiment of such downmixing, there is filtering of the Head-Related Transfer Function or complex panning, which divides the total frequency range into specific bands and performs panning.

The audio signal processing method according to the present invention may be implemented as a program that can be executed by various computer means. In this case, the program may be recorded on a computer-readable storage medium. Also, multimedia data having a data structure suitable for the present invention may be recorded on the computer-readable storage medium.

The computer-readable storage medium may include all types of storage media in order to record data readable by a computer system. Examples of the computer-readable storage medium include the following: ROM, RAM, CD-ROM, magnetic tapes, floppy disks, optical data storage, and the like. Also, the computer-readable storage medium may be implemented in the form of carrier waves (for example, transmission over the Internet). Also, the bit-stream generated by the above-described encoding method may be recorded on the computer-readable storage medium, or may be transmitted using a wired/wireless communication network.

Meanwhile, the present invention is not limited to the above-described embodiments, and may be changed and modified without departing from the gist of the present invention, and it should be understood that the technical spirit of such changes and modifications also belong to the scope of the accompanying claims.

What is claimed is:

1. An audio signal processing method, comprising:

receiving a bit-stream including both a normal channel signal and an exceptional channel signal;

decoding the exceptional channel signal and the normal channel signal from the received bit-stream;

decoding channel configuration information from the received bit-stream;

receiving speaker position information of a reproduction end;

deriving a gain value based on at least one among the channel configuration information and the speaker position information of the reproduction end;

compensating for the gain value and delay for each speaker; and outputting the exceptional channel signal as multiple channel signals using the gain value, wherein the compensating for the gain value and the delay are performed based on the speaker position information, wherein the deriving the gain value comprises delivering a sum of absolute values of differences for all speakers, each of the differences being a difference between a sneaker position of the reproduction end and a corresponding speaker position according to a standard specification, and wherein the deriving the gain value for at least one speaker among the all speakers is performed adaptively based on the sum of absolute values of the differences.

2. The audio signal processing method of claim 1, wherein speaker position information according to a standard specification is derived based on the channel configuration information, and wherein at least one among the speaker position information according to the standard specification and the speaker position information of the reproduction end comprise information on at least one among azimuth and elevation of a speaker.

3. The audio signal processing method of claim 1, the speaker position information of the reproduction end is represented as a difference between a speaker position of the reproduction end and a speaker position according to the standard specification.

4. The audio signal processing method of claim 1, wherein the deriving the sum is performed without considering a LFE channel.

5. The audio signal processing method of claim 1, wherein the deriving the gain value calculates the gain value for a speaker of the reproduction end using VBAP (Vector Based Amplitude Panning).

6. The audio signal processing method of claim 1, wherein the exceptional channel signal is a VoG (Voice of God) signal.

* * * * *